US005133117A

United States Patent [19]

Lomasney

[11] Patent Number: 5,133,117

[45] Date of Patent: Jul. 28, 1992

[54] DEVICE FOR APPLYING SPREADABLE COATINGS

[75] Inventor: Henry L. Lomasney, New Orleans, La.

[73] Assignee: Isotron, New Orleans, La.

[21] Appl. No.: 704,834

[22] Filed: May 20, 1991

Related U.S. Application Data

[63] Continuation of Ser. No. 283,920, Dec. 13, 1988, abandoned.

[51] Int. Cl.[5] ..... B05C 17/02

[52] U.S. Cl. ..... 29/110.5; 29/121.1; 29/121.4; 29/121.5; 29/127

[58] Field of Search ..... 29/121.1, 121.2, 121.4, 29/121.5, 116.1, 110.5, 127; 118/110, 414

[56] References Cited

U.S. PATENT DOCUMENTS

| | | | |
|---|---|---|---|
| 1,957,963 | 5/1934 | Johnstone | 29/121.2 |
| 2,066,780 | 1/1937 | Holt | 118/414 |
| 2,485,428 | 10/1949 | Bleier | 29/121.2 |
| 3,332,131 | 7/1967 | Weiler | 29/121.4 |
| 3,718,117 | 2/1973 | Lewicki | 118/414 |
| 4,476,806 | 10/1984 | Lubmewski | 29/110.5 |
| 4,742,597 | 5/1988 | LaFlamme | 29/110.5 |

FOREIGN PATENT DOCUMENTS

| | | | |
|---|---|---|---|
| 569214 | 1/1933 | Fed. Rep. of Germany | 29/121.4 |

*Primary Examiner*—Irene Cuda
*Attorney, Agent, or Firm*—Foley & Lardner

[57] ABSTRACT

A device for applying a substantially uniform thickness of a spreadable coating on a substantially planar surface has a handle, a roller attached to the handle, and a spacer on the outer peripheral surface of the roller for engaging the surface to be coated. The spacer defines an arc of at least about 360° around the outer peripheral surface of the roller for maintaining the outer peripheral surface of the roller both in communication with and spaced from the surface to be coated at a distance corresponding to the radial thickness of the spacer means during travel of the roller over the surface to be coated. In one embodiment, the spacer is a filament helically wound about the outer peripheral surface of the roller. The filament is releasably mounted to the roller and has a substantially uniform radial thickness. Also disclosed are methods for making and using the device of this invention.

8 Claims, 1 Drawing Sheet

DEVICE FOR APPLYING SPREADABLE COATINGS

This application is a continuation of application Ser. No. 07/283,920, filed Dec. 13, 1988, now abandoned.

BACKGROUND OF THE INVENTION

This invention relates to a device which is useful for applying a uniform thickness of a spreadable coating to planar surfaces and, in particular, for applying self-levelling coatings to floors.

There are certain floor coatings which require highly specialized application techniques in order to obtain the desired surface finish and performance characteristics. Examples of such coatings are the high performance polymeric floor coating systems called "self-levelling systems".

A major problem in installing such systems is that they must be applied evenly over the surface at least to the extent that there are no puddles or excessive build-up areas, and conversely, no thin or uncoated regions. Conventional rollers or brushes are relatively ineffective with such floor coating systems because rollers and brushes do not permit the desired uniform application. Further, the application must proceed relatively quickly because such coatings routinely involve two package materials whose cure rate is rapid, thereby limiting useful working time.

Some have attempted to solve the problem by designing a notched trowel, a notched rubber squeegee, or a screed bar that is dragged through the coating to "calendar" the coating in much the same way as adhesive is spread for the installation of floor tile. However, many secondary problems result from these approaches. For example, the notched steel trowel approach places unreasonable demands on the coating's "flow out" or "self-levelling" ability with the consequence that the desired surface finish is not achieved, especially that portion of the material which is applied toward the end of the pot-life. Moreover, the device is difficult to clean, and the amount of material applied varies with angle of the trowel to the floor.

The notched rubber-squeegee approach suffers the same weakness as the steel trowel described above, and further, can yield varying results depending on pressure applied by applicator. A screed bar incorporates a multitude of spacer pins that theoretically keep the screed bar positioned uniformly above the floor surface, thereby "calendaring" a uniform layer of coating material. In reality, because the screed pins must scrape through the coating, the bar tends to leave grooves in the floor which often do not flow out uniformly, resulting in undulations in the floor. The screed bar is also difficult to clean, difficult to adjust, and performs especially poorly if the floor surface is rough. Complications can also occur when the material collects on this device and subsequently drips on the finished floor, resulting in an imperfection. A screed bar is further limited because it typically can be used in only one direction, i.e., it is not a bi-directional device.

Accordingly, it would be desireable to have a device that is useful for applying spreadable coatings on planar surface such as self-leveling coatings, and that overcomes some or all of the above disadvantages.

SUMMARY OF THE INVENTION

The present invention overcomes the problems and disadvantages of the prior art by providing a device useful for applying a substantially uniform thickness of a spreadable coating on a planar surface. A device in accordance with this invention permits a person to simply apply a uniform thickness of a spreadable coating by rolling the device over the coating. Preferred embodiments of the invention can be easily cleaned and modified to provide coatings or different thickness.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the device of this invention comprises handle means; a roller, having an outer peripheral surface attached to the handle means; and spacer means mounted on the outer peripheral surface of the roller for engaging the surface to be coated. The spacer means extend about the peripheral surface of the roller and defines an arc of at least 360° for maintaining the outer surface of the roller both in communication with and spaced from the surface to be coated a distance corresponding to the radial thickness of the spacer means during travel of the roller over the surface to be coated.

In one aspect, the spacer means comprises a filament that has a substantially uniform radial thickness and is helically wound about the outer peripheral surface of the roller and is releasably mounted to the roller.

In another aspect, the spacer means has a substantially uniform radial thickness and comprises a protrusion that is substantially circular about the circumference of the roller.

In a further aspect, the invention includes a method for making a device in accordance with this invention, comprises the steps of releasably coupling a first end of a filament to a roller, winding the filament around the outer peripheral surface of the roller to device an arc of at least about 360°, and releasably coupling a second end of the filament to the roller.

In a still further aspect, the invention includes a method for applying a substantially uniform thickness of spreadable coating to a substantially planar surface, comprises the steps of placing a spreadable coating onto the surface, and rolling a device in accordance with this invention over the coating to spread the coating over the surface.

The accompanying drawings, which are incorporated in and constitute a part of this specification, illustrate several embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. The device of this invention is discussed first, followed by a discussion of the method of this invention.

The device of this invention can be used to apply a substantially uniform thickness of a spreadable coating onto a substantially planar surface. Some embodiments of the device are particularly easy to clean, can be easily modified for applying coatings of different thicknesses, and can apply a fairly uniform thickness coating even onto rough surfaces.

Figure 1:
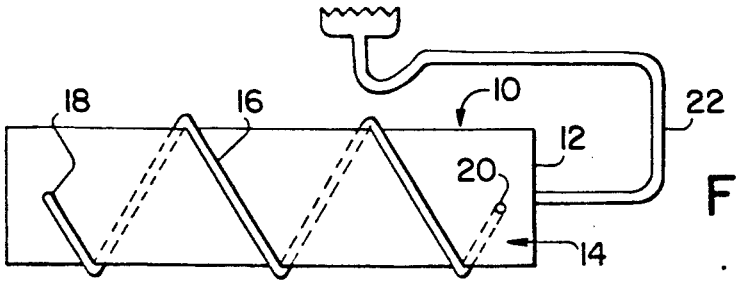
FIG. 1 is a top view of a first preferred embodiment of a device useful for applying spreadable coatings in accordance with this invention.

The device of this invention is illustrated by a first preferred embodiment shown in FIG. 1. As embodied herein, the device comprises tubular roller 12 having an inner surface (not shown), an outer peripheral surface 14 and spacer means 16. The roller can be constructed of any material which has sufficient resistance to the spreadable coating being applied to retain its integrity. The other main factor to consider is the weight of the roller, which is preferably sufficient to force the spacer means the contact with the planar surface below the spreadable coating, thereby keeping the spacer means in relatively constant communication with the planar surface as the device is moved across the surface. If a lightweight roller is chosen, the operator must apply sufficient downward pressure to keep the spacer means in contact with the surface being coated. In practice, a seamless copper tube having an inside diameter of 1.5 inches and a 0.40 inch wall thickness can provide good results.

In accordance with this invention, the spacer means is mounted to the outer peripheral surface of the roller and facilitates applying the spreadable material over the surface to the coated to achieve a uniform thickness coating. If the roller is substantially cylindrical, the spacer means should have a substantially uniform radial thickness and define an arc of at least about 360° around the outer peripheral surface of the roller. The spacer means should thus maintain the outer peripheral surface of the roller both in communication with and spaced apart from the surface being coated at a distance corresponding to the radial thickness of the spacer means during travel of the roller over the surface to be coated. The spacer means can comprise molded protrusions permanently mounted to the outer peripheral surface of the roller, or releasably mounted protrusions such as the filament shown in FIG. 1.

Preferably, the spacer means comprises a filament such as a polymeric monofilament used in a fishing or weed trimming devices, a metalic wire, conventional cordage or other filament. The spacer means will generally be from about 10 mils to about 30 mils in thickness to correspondingly provide a surface coating of from about 10 mils to about 30 mils. Of course, it will be readily understood that spacer means which will provide other radial thickness also can easily be used in accordance with this invention.

In the first embodiment, the spacer means is a filament that is of substantially uniform radial thickness along its length, and is helically wound about the outer peripheral surface 14, having one end at opening 18 and a second end at opening 20. In this preferred embodiment, the filament is would helically about the circumference of the roller 12 abut 2.5 times and is releasably mounted to the roller 12 as hereinafter described. The roller is releasably attached to handle means 22 for facilitating rolling the roller across the surface to be coated.

For most applications, the helical configuration of FIG. 1 is particularly advantageous because when the roller is rolled over a spreadable coating, the excess coating material will exude from one of the sides of the roller, depending on the direction of rolling. The pitch rate, i.e., the number of winds of filament per unit length of the roller, can be varied to optimize performance. In general, from about 2 to about 10 winds on a 12 inch long roller will provide good results. In particular, 5 winds have provided good results.

Figure 2:
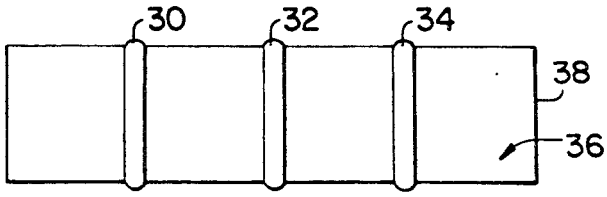
FIG. 2 is a top view of a second embodiment of a roller useful for applying spreadable coatings in accordance with this invention.

Alternatively, as illustrated by FIG. 2, the spacer may comprise circular rings 30, 32 and 34 that are slipped onto the outer peripheral surface 36 of the roller 38 and held in place by friction, by a recess in the outer peripheral surface or by other means for releasably or permanently coupling a ring to the outer peripheral surface of the roller.

Figure 3:
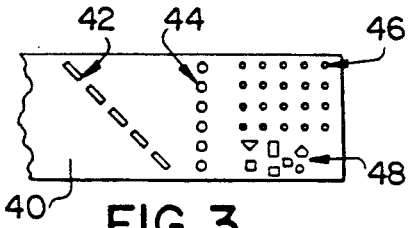
FIG. 3 is a partial top view of a third embodiment of a roller useful for applying spreadable coatings in accordance with this invention.

As illustrated by FIG. 3, the spacer means may also comprise discontinuous protrusions of substantially uniform radial thickness. For example, roller 40 can contain discontinuous protrusions 42 in a helical pattern, discontinuous protrusions 44 in a circular patter, discontinuous protrusions 46 in an array, or discontinuous protrusions 48 in a random pattern. Moreover, as illustrated, the cross-section of the protrusions can vary. In such instances, it is necessary that the protrusions be in sufficiently close proximity to continuously maintain the roller at a distance from the surface corresponding to the radial thickness of the protrusions.

The invention includes handle means which may comprise any means releasably or permanently attached to the roller to facilitate movement of the roller over the surface to be coated. Handle means may also comprise any openings, recesses, indentations, or other areas of the roller which facilitate handling of the roller. In a preferred embodiment illustrated by FIG. 4, handle means comprises a conventional paint roller frame which can be releasably attached to the roller.

Figure 4:
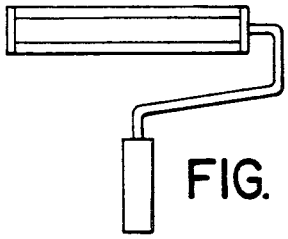
FIG. 4 is a top view of a conventional paint roller frame on which a roller in accordance with the invention may be removably mounted.
Figure 5:
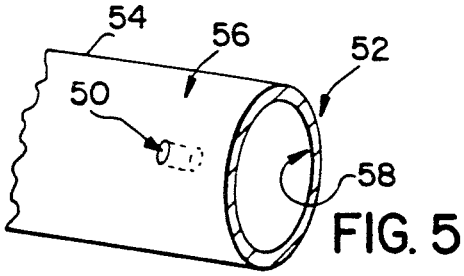
FIG. 5 is a fragmentary view in perspective illustrating one end of the roller of FIG. 1 for removably attaching one end of a fillament to the roller.
Figure 6:
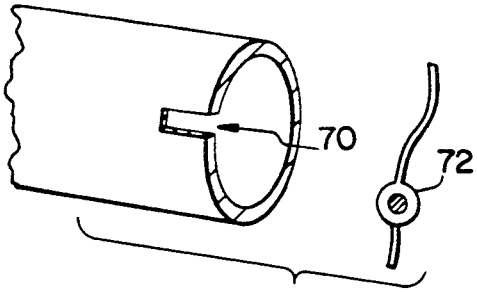
FIG. 6 is a fragmentary view in perspective of one end of a roller illustrating a modified structure for removably attaching one end of a fillament to the roller.

As discussed above, the spacer means is preferably a filament such as a polyolefin polymeric monofilament used in fishing or weed trimming devices. The monofilament can be mounted on the roller, for example, by using openings as shown in FIGS. 1, 5 and 6. The device of FIG. 1 can be constructed by inserting one end of the monofilament spacer means 16 into a first opening 18 in the roller 12, helically winding the monofilament around the outer peripheral surface 14 of the roller about 2.5 times, and inserting the second end of the monofilament into a second opening 20 in the roller. The first and second monofilament ends can generally be attached to the inner peripheral surface of the roller by any means that do not interfere with the operating the device. A preferred method of attaching the monofilament ends is by heating and swaging as described below. In a preferred embodiment illustrated by FIG. 5, when the opening is a hole 50, good results have been obtained when the hole 50 is angled toward the end 52 of the roller 54 from the outer peripheral surface 56 to the inner peripheral surface 58. It is also preferable that the inner peripheral surface of the hole be provided with a recess (not shown), i.e. that the inner peripheral surface of the hole 50 be "counter sunk" to provide a convenient area in which to attach the end of filament to the inner peripheral surface of the roller. The monofilament can then be inserted through the hole and secured by heating and swaging the free end of the monofilament into the recess of the hole. Heating can be accomplished, for example, by holding a flame near the filament end for a time sufficient to render the end plastic. Swaging can be accomplished, for example, by using any flat surface such as a spatula to smooth and work the heated, thermoplastic monofilament into the swage. How-swaging the monofilament will result in the tubular member having a smooth inner surface that will easily slide onto a paint roller frame such as that shown in FIG. 4.

Alternatively, as shown in FIG. 6, the opening can be a slot 70 into which a knotted filament end is inserted, heated and hot-swaged.

After the monofilament or other spacer means is mounted on the roller, the roller is then preferably attached the handle means to facilitate rolling the roller across the surface to be coated. Such means can include, for example, a paint roller frame such as shown in FIG. 4, which enables the roller to rotate about its central longitudinal axis. Obviously, other handle means as described above for facilitating rolling the roller over the surface to be coated can also be used.

Figure 7:
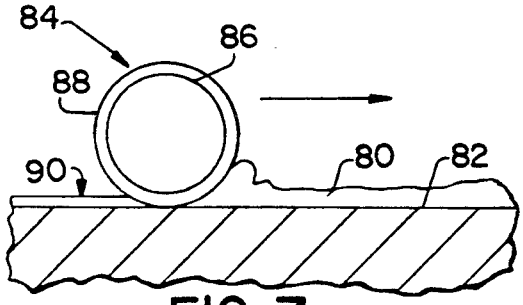
FIG. 7 is an end view of a device in accordance with this invention illustrating the application of a spreadable coating to a surface.

The method for coating a surface is simple and straightforward. As illustrated by FIG. 7, a quantity of spreadable coating 80 is first placed onto a surface 82. A device 84 in accordance with this invention comprising a handle (not shown), a roller having an outer peripheral surface 86 and spacer means 88 is then rolled in the direction shown over the coating to distribute it along the surface 82. Sufficient downward pressure should be applied to ensure that the spacer means 88 maintains the outer peripheral surface of the roller both in communication with and spaced from the surface 82 under the coating, thereby ensuring a relatively even coating 90 having a thickness equal to the radial thickness of spacer means 88. If helical spacer means are chosen, the excess coating will exude from the one side of the roller, and thus the roller should generally be rolled across in the same direction to prevent excess coating from exuding onto an area where the coating has already been applied.

After the coating has been applied, the device can be cleaned for reuse. If permanently mounted spacer means are chosen, the device should likely be soaked in solvent and then wiped clean. If a releasably mounted spacer means such as a filament is chosen, it should be removed, for example, by simply cutting, and the roller wiped free of coating. Different thickness of filament can then be remounted to the roller for use as described above, to provide coatings of different thicknesses.

It will be apparent to those skilled in the art that various modifications and variations can be made in the device of the present invention and in the methods for making and using the device without departing from the scope or spirit of the invention. For example, it will be readily apparent to those skilled in the art that other types of spacer means can be used on the outer peripheral surface of a roller and still provide substantially the same results as discussed above. Thus, it is intended that the present invention cover the modifications and variations of this invention provided they come within the scope of the appended claims and their equivalents.

What is claimed is:

1. A handheld device for applying a substantially uniform thickness of spreadable coating on a planar surface; comprising:

a handle;

an elongated roller rotatably attached to the handle means to rotate about a central axis, said roller having an outer peripheral surface; and an elongated continuous spacer extending outwardly from the surface of the roller a substantially uniform distance helically surrounding and releasably mounted in substantially continuous physical engagement with the outer peripheral surface of the roller for engaging the surface to be coated and spacing the substantially planar peripheral surface of said roller a predetermined uniform distance from the surface to be coated during travel of the roller over the surface to be coated wherein at least a portion of said handle extends outward and away from said roller in a direction which is not parallel to the central axis of said roller.

2. The device of claim 1, wherein said spacer comprises a filament.

3. The device of claim 2, wherein said filament is from about 10 mils to about 30 mils in thickness.

4. The device of claim 2, wherein said roller has an outer surface and an inner surface, and hat at least one opening from said outer surface to said inner surface through which said filament passes.

5. The device of claim 4, wherein said roller has a first opening and a second opening through which a first end and a second end of said filament pass, respectively.

6. The device of claim 5, wherein said filament is from about 10 mils to about 30 mils in thickness.

7. A handheld device according to claim 1, wherein the roller is an annulus having an inner peripheral surface and first and second openings therein, each opening extending from the outer peripheral surface to the inner peripheral surface, and wherein the spacer has a first end attached to the roller by passing through the first opening and a second end that is attached to the roller by passing through the second opening.

8. The device of claim 7, wherein the spacer comprises a filament having a uniform thickness of from about 10 mils to about 30 mils.

* * * * *